United States Patent [19]

Powell et al.

[11] 4,085,590

[45] Apr. 25, 1978

[54] HYDRIDE COMPRESSOR

[75] Inventors: James R. Powell, Wading River; Francis J. Salzano, Patchogue, both of N.Y.

[73] Assignee: The United States of America as represented by the United States Department of Energy, Washington, D.C.

[21] Appl. No.: 646,703

[22] Filed: Jan. 5, 1976

[51] Int. Cl.[2] ..... F01K 25/10

[52] U.S. Cl. ..... 60/673; 60/649; 60/671; 34/15

[58] Field of Search ..... 60/649, 650, 682, 651, 60/671, 653, 673; 34/15; 62/48

[56] References Cited

U.S. PATENT DOCUMENTS

| | | | |
|---|---|---|---|
| 2,471,476 | 5/1949 | Benning et al. | 60/651 X |
| 3,040,528 | 6/1962 | Tabor et al. | 60/651 |
| 3,943,719 | 3/1976 | Terry et al. | 60/649 X |
| 3,950,949 | 4/1976 | Martin et al. | 60/676 X |

*Primary Examiner*—Allen M. Ostrager
*Attorney, Agent, or Firm*—Dean E. Carlson; Cornell D. Cornish

[57] ABSTRACT

Method of producing high energy pressurized gas working fluid power from a low energy, low temperature heat source, wherein the compression energy is gained by using the low energy heat source to desorb hydrogen gas from a metal hydride bed and the desorbed hydrogen for producing power is recycled to the bed, where it is re-adsorbed, with the recycling being powered by the low energy heat source. In one embodiment, the adsorption-desorption cycle provides a chemical compressor that is powered by the low energy heat source, and the compressor is connected to a regenerative gas turbine having a high energy, high temperature heat source with the recycling being powered by the low energy heat source.

1 Claim, 2 Drawing Figures

HYDRIDE COMPRESSOR

STATEMENT OF GOVERNMENT INTEREST

This invention was made under, or in connection with a contract with the United States Energy Research and Development Administration, or its predecessor, the United States Atomic Energy Commission.

BACKGROUND OF THE INVENTION

In the field of power production, stored energy is often employed. For example, U.S. Pat. No. 3,508,414, to Richard H. Wiswall et al., discloses a method of storing hydrogen on metal hydrides. To this end, the gas is stored by contacting it with a solid titanium-iron alloy containing from about 35 weight percent to about 75 weight percent titanium based upon the total weight of the titanium-iron alloy and from about 25 weight to about 65 weight percent iron based upon the total weight of the titanium-iron alloy, while maintaining the hydrogen and the alloy at a pressure of at least about 14 pounds per square inch, and at a temperature of at least about 10° C until the alloy adsorbed up to the stochiometric limit.

In one example, the described hydrogen-titanium-iron complexes are capable of emitting hydrogen at a pressure of about 3 atmospheres at ambient temperatures of 20° C. Moreover, a rapid desorption of the hydrogen under pressure can be effectuated by applying heat to the complex. To this end, all that is required to be done is to allow the hydrogen to be desorbed in a closed system.

A unique feature of the described complex is the fact that hydrogen is desorbed at a desired or constant rate from the complex when the complex is heated to a specific temperature of 25° C until the complex contains no hydride phase. For example, a hydrogen-titanium-iron complex containing two weight percent hydrogen based upon the weight of the titanium-iron alloy, upon being heated to a constant temperature of 25° C, will maintain a hydrogen pressure of $> 15$ lbs. per square inch above the alloy until about 1.0 weight percent of hydrogen remains in the complex. Thus, this feature provides those skilled in the art with a simple hydrogen source in which the rate of release can be carefully controlled by simply controlling the temperature of the complex during the desorption.

SUMMARY OF THE INVENTION

It has now been discovered that high energy pressurized hydrogen gas working fluid power can be produced from a low energy, low temperature heat source, wherein energy for the high energy pressurized hydrogen gas working fluid can be gained by using the low energy heat source to desorb the hydrogen from a metal hydride, and then recyling the hydrogen to the metal hydride, where the hydrogen is re-adsorbed, with the recycling being powered by the low energy heat source. Thus, the adsorption-desorption provides a chemical compressor that can be connected to a regenerative gas turbine cycle having a high energy heat source in a two stage heating process, in which the compressor and recycling are powered by the low energy heat source. Considering each bed, the method involves essentially 2 cycles, namely a power cycle and a recharging cycle. In the power cycle the hydrogen is desorbed from at least one hydride first bed. When this power cycle is completed, the gas is readsorbed in a second cycle. By using a plurality of beds, which may comprise inner and outer porous and non-porous aluminum tubes sandwiching the hydride therebetween, and arranging the beds so that a plurality of beds are absorbing, while a plurality of beds are heating, while a plurality of beds are desorbing, while a plurality of beds are cooling, and so that the beds are sequentially periodically cycled to adsorb, heat, desorb and cool, power is continuously produced.

In one embodiment, a low energy heat source is used to desorb hydrogen from a metal hydride bed at a first equilibrium hydrogen pressure when the temperature of the bed is at $T_1$; power is extracted from the desorbed hydrogen followed by recycling the hydrogen to the metal hydride bed, while removing heat therefrom to the surroundings, using a low energy heat source to power the recycling so that the temperature of the recycled hydrogen is at a temperature $T_2$ when the ambient is at a temperature $T_3$; and readsorbing the recycled hydrogen on the metal hydride bed in a closed cycle at a second equilibrium hydrogen pressure while cooling the bed by rejecting heat to the surroundings so that the temperature of the bed during said readsorption is at $T_2$, and $T_1 > T_2 > T_3$. Meanwhile, a high temperature second heat source at a temperature T above $T_1$ is used to heat the desorbed hydrogen before extracting power therefrom. To this end, it is advantageous simultaneously to employ the desorption-adsorption in a chemical compressor connected to a standard regenerative gas turbine having a high temperature heat source for producing power from the desorbed hydrogen in a closed cycle, wherein the recycling is powered by the low energy heat source. With the proper selection of steps and conditions, as described in more detail hereinafter, the desired power is produced.

OBJECTS OF THE INVENTION

It is an object of this invention, therefore, to produce high energy hydrogen gas working fluid power from a low energy heat source.

It is another object to use a metal hydride bed as a chemical compressor.

It is a still further object to connect a chemical compressor to a regenerative gas turbine for producing high energy hydrogen gas working fluid power from a low energy heat source.

The above and further novel features and objects of this invention will become apparent from the following detailed description when read in connection with the accompanying drawing, and the novel features will be particularly pointed out in the appended claims.

BRIEF DESCRIPTION OF THE DRAWING

In the figures, where like elements are referenced alike.

DESCRIPTION OF THE PREFERRED EMBODIMENT

This invention is useful in chemically compressing a working fluid to have stored energy therein for producing electrical power from a generator, such as described in U.S. Pat. No. 3,504,494 to Winsche et al. Accordingly, this invention is useful for the wide variety of applications to which mechanical compressors and electrical generators have been applied heretofore.

It is known that electrical power can be produced from regenerative gas turbines by connecting the turbines to standard electrical generators. A regenerative gas turbine is shown and discussed in United Aircraft Research Laboratories Report N-951865-1, dated June 1974 by M.D. Meader and F.R. Biancardi, which is incorporated by reference herein. Regeneration of the working fluid by this type of regenerator is based on the fact that the high pressure and high temperature gas streams counterflow with relation to each other. While numerous possibilities exist, the configuration selected for this application is a plate-fin regenerator in use in industrial power generation, as described in the cited UARL report. Power extraction is based on the use of a gas turbine between the high pressure and high temperature gas streams, using a conventional turbine, as described in the cited UARL report, which is incorporated by reference herein. The invention hereinafter described, utilizes a closed regenerative gas turbine cycle system of this type in which the input high pressure cold gas to the regenerative-turbine cycle is subjected in a manner described below in connection with particular configurations of these regenerative-turbine cycles to compression by a chemical compressor of the hydride type, in which the gas is desorbed by a low energy heat source, and the output from the regenerative-turbine cycle is recycled through the compressor using the low temperature heat source to power the recycling. A mathematical treatment of the principles involved in this invention is given in Brookhaven National Laboratory Report BNL 50447, dated Jan. 31, 1975, by the inventors herein and others who are not inventors herein but who were listed on the report only to give them credit for their collaboration in the research described in the report.

Figure 1:
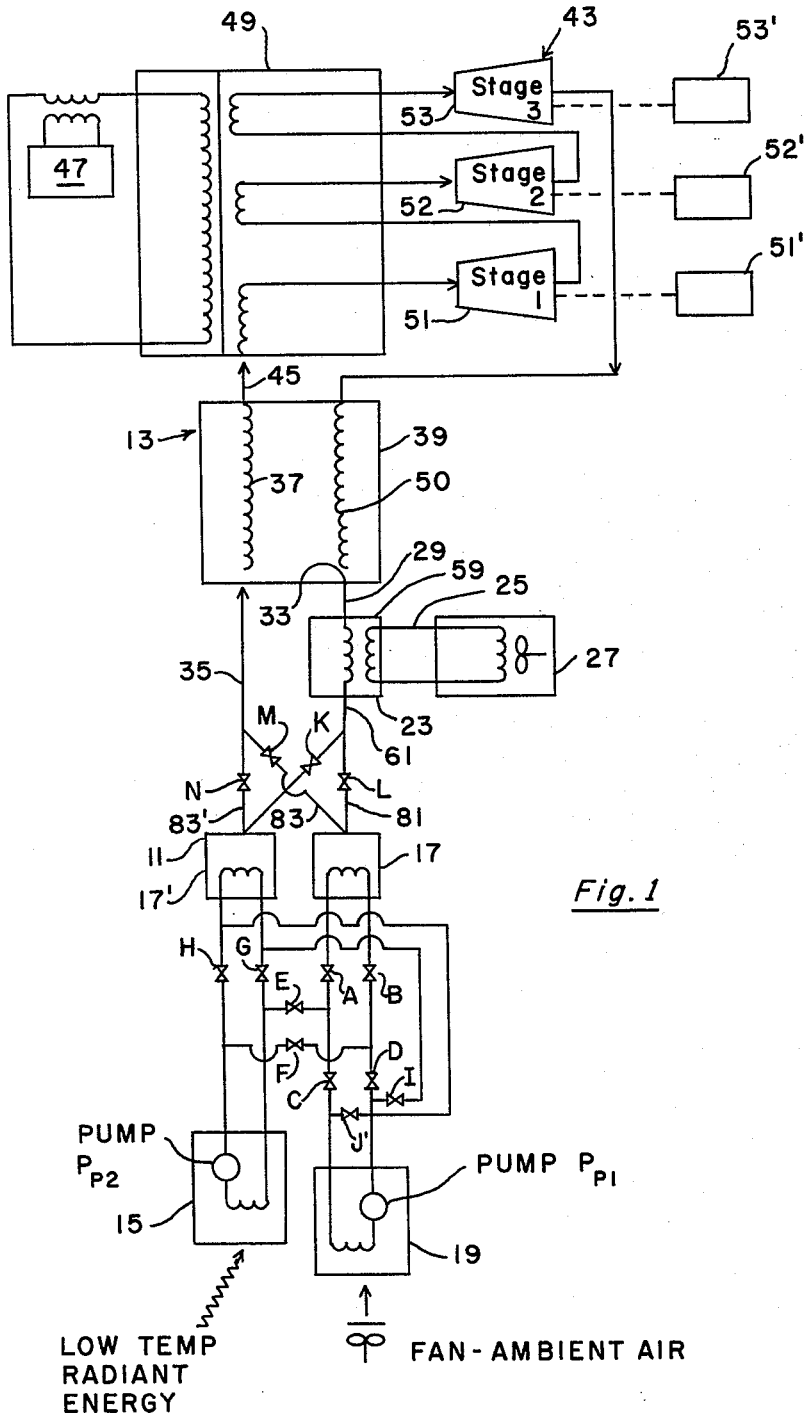
FIG. 1 is partial schematic diagram of the apparatus for performing the method of this invention.

In understanding this invention, reference is made to FIG. 1, which is a schematic diagram of one embodiment of apparatus for performing the method of this invention in which the first hydride bed of the cited U.S. Pat. No. 3,504,494 is used as a chemical compressor 11, and this chemical compressor is connected to the conventional regenerative turbine system 13 of the above cited reference in a closed cycle. Should a low temperature, low energy heat source 15, such as a solar or geothermal heat source, be used to heat the hydride bed 17 in the compressor to desorb the hydrogen that is adsorbed thereon, should this desorbed hydrogen be heated to high temperature and passed through a regenerative turbine to extract power from the hydrogen, and should the resulting hydrogen be recycled to the hydride bed in the chemical compressor using the low energy heat source to power the recycling, the desired power is unexpectedly produced efficiently in a two stage heating process in which the low energy heat source is used to power the compressor and to recycle the working fluid, and the high energy heat source is efficiently used at high temperature to produce the desired power.

Referring further to FIG. 1, in a practical embodiment, wherein a hydride bed 17 is illustrated schematically for ease of explanation in explaining the adsorbing cycle, cooling fluid circulates from pump $P_{p1}$ through the bed 17 and a low temperature heat sink 19 to cool the bed to the desired adsorption temperature. To this end, valves A and B and C and D are opened and valves E and F are closed. In this adsorption cycle, hydrogen, which is under pressure, is adsorbed in the bed 17 after being cooled in heat exchanger 23, which is connected in a coolant circuit 25 to a low temperature heat sink 27, and in a cooling circuit 29 to the regenerative turbine output 33. To this end, valves K and L are open and M and N are closed.

In the desorption cycle, which has two stages that follow the adsorption cycle, the hydride bed 17 is first disconnected from the heat sink 19 and both the regenerative turbine input and output to form a closed compression chamber, and is connected to the low temperature heat source by opening and closing suitable valves. To this end, for example, the hydride bed 17 forms a compression chamber by closing valves N, M, K and L, while the hydride bed 17 is connected to the low temperature heat source 15 by closing valves C, D, G and H and opening valves E and F. When the temperature of the hydride bed is raised far enough by the low temperature source 15 to pressurize the gas in the compression chamber, then the second stage of the desorption cycle begins during which time the adsorbed gas is desorbed from the hydride into the regenerative turbine 13 at high pressure by opening valve M while valve N remains closed.

During the regenerative turbine cycle which follows, the valve M is left open until substantially all the adsorbed hydrogen in bed 17 is desorbed into the regenerator for input 35. Then valve M is closed for the beginning of a new adsorption cycle in which valves K and L are opened and the hydride bed 17 is reconnected to the low temperature heat sink 19. Meanwhile, during the power extraction portion of the regenerative turbine cycle, the hydrogen released from bed 17 while valve M is open works its way through regenerator input 35 in a high pressure stream 37 and from the regenerator 39 to the turbine 43 in a stream 45 that is heated by a high energy, high temperature heat source 47. To this end, the hydrogen from the regenerator input 35 in stream 37 passes through the heat exchanger 49 of the high energy, high temperature heat source 47 and expands into a low pressure, high temperature, hydrogen stream 50 by passing through one or more stages 51, 52 and 53 of turbine 43, which rotates conventional generators 51', 52' and 53' for producing electrical power. Thereupon, the low pressure high temperature hydrogen stream 50 flows through the regenerator 39 in a direction counter to the direction of the high pressure low temperature stream 37 from the hydride chemical compressor 11, with a temperature difference of only up to about 100° C. This has the effect of efficiently exchanging the heat from the low pressure stream 50 to the high pressure stream 37, e.g. with a high efficiency up to over 90%. The exhaust low pressure gas from the regenerator 39, with most of its heat removed therefrom into the high pressure gas from the bed 17, is then circulated through a low temperature heat exchanger 59 for removal to a low temperature heat sink, such as ambient air. The low temperature output stream 61 from the heat exchanger 59 is then ready for readsorption in a closed cycle on bed 17. To this end, the valves K and L are opened and the valves M and N are closed until the hydride, which has already been cooled by opening valves A, B, C and D and closing valves E and F, becomes saturated with the low temperature hydrogen from stream 61. Thereupon, the bed 17 is ready for another intermittent desorption cycle, as described above.

In an alternate embodiment, which is illustrated in FIG. 1, a plurality of additional hydride beds are provided, one of which is shown as bed 17' for ease of explanation. By suitably valving the various hydride beds, which each form a chemical compressor 11 in accordance with this invention, the described adsorption-desorption cycles and steps are carried out in parallel so that one or more of the plurality of beds is adsorbing, while one or more of the plurality of beds is heating, desorbing, or cooling respectively, and each of the beds is sequentially periodically cycled to adsorb, heat, desorb, and cool respectively and is sequentially periodically connected in a closed cycle to the power extracting turbine generator system through the regenerator 39 continuously to extract power from the stored hydrogen, which by the system of this invention is compressed in chemical compressor 11 and recycled through the regenerative turbine system 13 by the power from the low energy heat source 15, while the high energy heat source 47 heats the compressed hydrogen in a Brayton or Rankine regenerative cycle, so that the power extraction from the high energy heat source is highly efficient.

In one embodiment of the hydride bed 17 of FIG. 1, the hydride bed utilizes the $FeTiH_x$ hydride apparatus actually supplied to the Public Service Electric and Gas Company of New Jersey by the Brookhaven National Laboratory. In this embodiment, the compressor 11 is formed by a shell and tube type heat exchanger, with the $FeTiH_x$ compound located on the shell side and a tube bundle penetrating the granular bed of the hydride. Hydrogen is injected into and removed from the bed through small-diameter porous tubes dispersed in the bed and connected to a common header to allow the bed to be contained while allowing the passage of gas into and out of the bed. Cooling and heating are accomplished by circulating oil or water at the desired temperature through a "water" jacket around the cooler. During the discharge (desorption cycle) hot oil, water (or steam) from the low energy low temperature source 15 is circulated through the tubes to heat the bed and then to produce high hydrogen pressure by evolving hydrogen from the bed at the nominal equilibrium pressure over the $FeTiH_x$, whereby the required work of compression comes entirely and directly from the energy in the waste or low energy, low temperature heat source 15, in contrast to a conventional closed cycle gas turbine, or other system in which the work of compression is mechanical.

Figure 2:
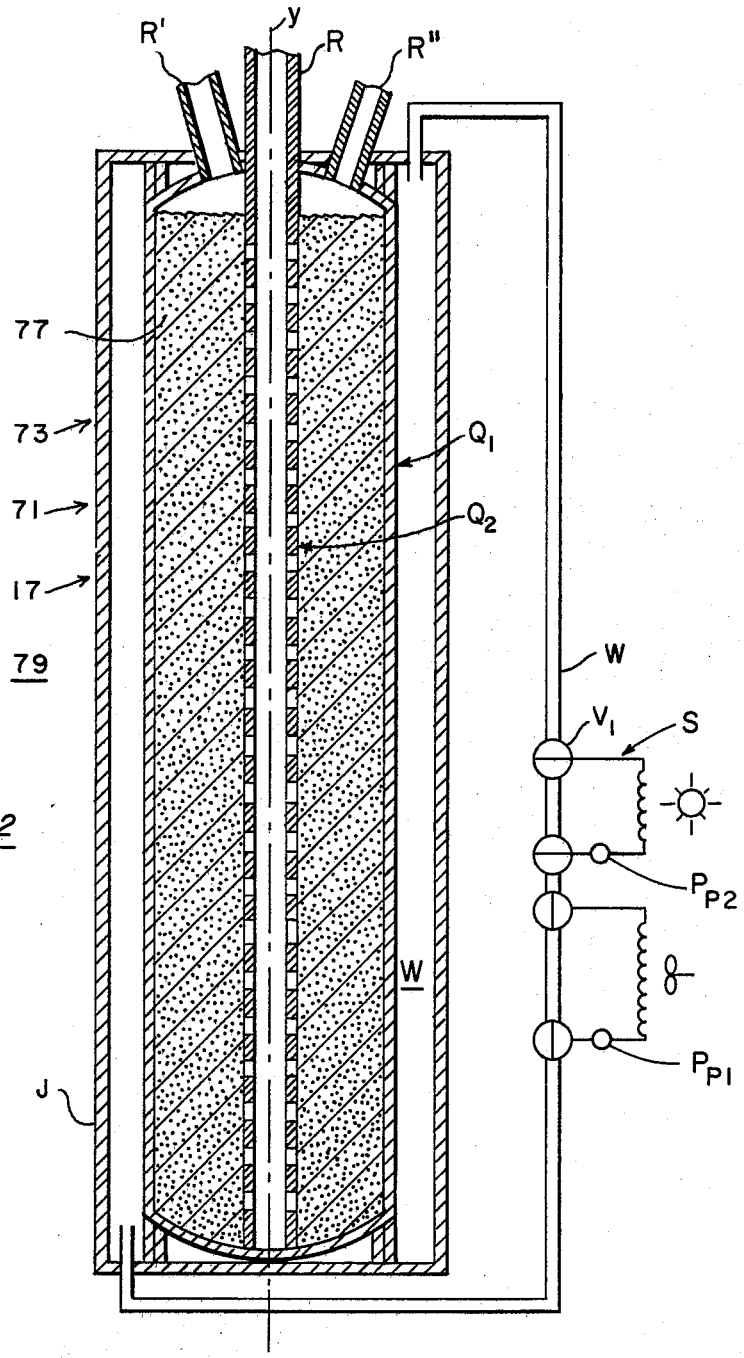
FIG. 2 is a partial cross-section of one embodiment of a hydride adsorption-desorption apparatus for performing the method of FIG. 1.

In a preferred embodiment for the adsorber-desorber chemical compressor 11 of this invention shown in FIG. 2, a longitudinally extending cylinder 71 is provided that contains a set 73 of porous and non-porous tubes $Q_1$ and $Q_2$ having gas containing metal hydride 77 in beds 17 therebetween and forming longitudinally extending spaces 79 between the beds. Suitable reversible inlets and outlets R, R' and R'', as well as pumps $P_{p1}$, and $P_{p2}$ for the low energy heating and cooling, such as shown in FIG. 1, are also provided therefor.

One of the most important factors affecting the design of the hydride beds 17 is the means for handling the thermal load. Water or oil are readily available at temperatures of 15°-50° C or more for the heat transport medium. Because direct contact with the hydride by the water or oil must be avoided, the water or oil is confined in ducts, or the hydride is sealed in containers immersed in the water or oil. The apparatus shown in FIG. 2 provides a water or oil jacket around porous and non-porous aluminum tubes sandwiching the hydride 77 therebetween. To this end, the inside wall of the jacket forms the outer non-porous tube $Q_1$, which is concentric with a central porous tube $Q_2$ along an axis of rotation Y. When heating the hydride, the hot heat transfer medium W circulates from a source S through the jacket, and when cooling the cold heat transfer medium circulates from a cooling means through the jacket by using suitable pumps, and opening and closing suitable valves, which are conventional, such as the two-way valves $V_1$ shown in FIG. 2. The inlets R, R' and R'', which are connected to porous tubes $Q_2$ that are buried in the hydride 77, transport the $H_2$ in and out of beds 17 for adsorbtion and desorption respectfully, as understood from FIG. 1.

In operation, the described valves of FIG. 1 and FIG. 2, +I, J', which comprise two-way valves $V_1$ for ease of explanation, are opened and closed to expose the beds 17 to the cooled low pressure hydrogen stream 61 through inlet 81 and inlets R, R' and R'' for adsorbing the hydrogen on the beds, and to desorb the adsorbed hydrogen into the desired high pressure stream 37 through outlet 83'-83 and outlets R, R' and R''. Also, the high temperature heat source has a temperature T that is about 3-4 times the desorption temperature $T_1$, $T_2$ is the adsorption temperature, $T_3$ is the ambient temperature, and $T > T_1 > T_2 > T_3$.

The following are examples of the method of this invention:

EXAMPLE I

Using the apparatus described above, water or silcone oil passes through a low energy heat source formed by a radiant solar energy collector such as a solar pond, or the low grade, waste heat from a conventional power plant, where the water or oil is heated to about 400° K and passed through a bed containing about 1 cubic foot of $FeTiH_x$, which upon being heated to about 300° K by the solar heat source 15, releases 0.3 gram moles of $H_2$ by desorption at several tens of atmospheres decomposition pressure while decomposing to the hydridable alloy FeTi. This requires standard amounts of energy. The heating step takes about 2-3 minutes and the desorption step takes a like amount of time. The desorbed hydrogen gas at a high pressure of several tens of atms. and a low temperature of 400° K is passed seriatim through a regenerator, where it is heated to 800° K, a high temperature heat exchanger, where it is heated to 1000° K, expanded through a turbine generator to a low pressure of less than a few atm. and a high temperature of 840° K, back through the regenerator in the opposite direction so that the gas gives up heat to the counterflowing low temperature high pressure gas, exits from the regenerator at a low pressure of less than a few atm. and at a temperature of 340° K, and through a low temperature heat exchanger, where the gas is cooled to ambient temperature of about 300° K for readsorption on the FeTi medium in the bed 17 for the beginning of new cycles in which the hydrogen is repeatedly, sequentially, periodically desorbed at about 300° K by the low energy solar heat source. The cooling step takes about 2-3 minutes and the adsorption step takes about the same amount of time.

To achieve counterflow performance in the regenerator, the described apparatus is employed. Alternately, the hot gas from the turbine enters at a first one end of the regenerator and passes back and forth across a tube bundle, constrained by baffles. The baffles serve to increase the shell side velocity, thus improving the heat transfer coefficient. The hot hydrogen exits at the other end of the regenerator after completing the final pass across the tubes. The high pressure gas enters at the first end and is distributed via a toroidal header to multiple parallel tubes. Flow is then in a direction through the tubes to the outlet header duct.

The high energy, high temperature source is a conventional high efficiency power plant, such as a conventional fossil fueled or nuclear power plant source of a high energy, high temperature working fluid, such as superheated steam.

EXAMPLE II

The steps of Example I are repeated using a plurality of hydride beds in which some of the beds are alternately periodically adsorbing, whiile other beds are heating, desorbing, cooling and adsorbing for continuously producing power.

EXAMPLE III

The steps of Example I and II are repeated using parallel aluminum plates sandwiching hydride beds therebetween so as to have spaces between the beds for a heat transfer fluid.

It can be seen from the preceding description and examples that the method and apparatus of this invention present an effective way for chemically compressing a working fluid with a low energy or waste heat source, and more importantly of using the energy from solar or other low energy sources for storing energy in a working fluid and circulating the same at high pressure for the heating of the same with a high energy source for the production of useful, high grade electrical power in a two stage process for efficiently converting the energy from the high energy source to produce power, while the low energy source powers the compression and recycling in a closed cycle.

EXAMPLE IV

The steps of the preceeding examples are repeated by compressing 0.3 g moles of $H_2$ per mole of FeTi by condensation during the adsorption of the $H_2$ on the metal hydride, the $H_2$ inlet pressure to the hydride beds is 200 psi, and the $H_2$ outlet pressure is 750 psi, in an ambient at about 20° C, the adsorption temperature being at least about 25° C, the desorption temperature being at least about 115° C, and the low temperature heat source being at least about 125° C.

EXAMPLE V

The steps of the preceeding examples are repeated using a temperature differential between the high and low pressure $H_2$ streams in the regenerator in the order of 100° F, and the high temperature heat source at a temperature between 600° and 1400° F that is 3–4 times the temperature of desorption, which corresponds to the temperature of the low temperature heat source.

While silicon oil or water are described as heat transfer media for the low energy heat source for desorption, and water or oil are described as heat transfer media for the low temperature heat exchanger for cooling the working fluid for adsorption, it is understood in the art from the description herein that other heat transfer media may be used.

It should also be noted that this invention is not limited to the specific metal hydrides described herein, but may be used with any metal hydrides that fit the broad concept of the invention as defined by the claims appended hereto.

More specifically, the use of metal hydrides, such as $Mg_2 Ni H_4$ and $La Ni_5 H_{6-7}$, or other more appropriate metal hydrides with solar collectors now under development, such as power towers, where temperatures of 500°–700° C are expected to be reached, falls within the scope of this invention.

This invention has the advantage that is employs low energy, waste heat and/or solar energy to power and circulate a high energy pressurized gas working fluid for producing power efficiently from a high temperature heat source. To this end, this invention has the advantage of providing a chemical compressor having a low energy power source that is connected to a regenerative turbine having a high energy heat source for efficiently producing power by supplying the energy for circulating the working fluid through the system.

What is claimed is:

1. Apparatus for producing hydrogen gas power comprising:

a. at least one longitudinally extending outer, nonporous, chemical pressure tube means containing inner, porous tube means having a metal hydride bed sandwiched therebetween for selectively desorbing and adsorbing hydrogen gas and having a longitudinally extending heat exchange jacket around the outer tube means;

b. low temperature heat source means connected to the heat exchange jacket for selectively heating the metal hydride bed to desorb hydrogen gas;

c. high temperature heat source means for receiving, transporting and further heating the desorbed hydrogen gas;

d. power extraction means for receiving and extracting power from the further heated hydrogen gas;

e. regenerator means for transferring heat from the hydrogen gas leaving the power extraction means to the desorbed hydrogen gas prior to the desorbed hydrogen gas entering the high temperature heat source; and f. cooling means connected to the heat exchange jacket for controlling the temperature of the metal hydride bed by selectively rejecting heat therefrom to the surroundings during adsorption of the hydrogen gas leaving the regenerator means.

* * * * *